US006840573B1

(12) United States Patent
Yao

(10) Patent No.: US 6,840,573 B1
(45) Date of Patent: Jan. 11, 2005

(54) CHAIR HAVING RIGID STRUCTURE

(76) Inventor: King-Yurn Yao, 4F, No. 98, Zhuang Yi St., Taoyuan (TW)

( * ) Notice: Subject to any disclaimer, the term of this patent is extended or adjusted under 35 U.S.C. 154(b) by 0 days.

(21) Appl. No.: 10/755,883

(22) Filed: Jan. 12, 2004

(51) Int. Cl.[7] ..... A47C 4/00
(52) U.S. Cl. ..... 297/16.1
(58) Field of Search ..... 297/56, 16.1, 16.2, 297/46, 48, 440.24, 452.2, 57, 18, 53, 29

(56) References Cited

U.S. PATENT DOCUMENTS 2,649,140 A * 8/1953 Housel ..... 248/431
3,385,630 A * 5/1968 Greiner ..... 297/19
5,893,604 A * 4/1999 Yao ..... 297/16.1
5,975,626 A * 11/1999 Aycock ..... 297/16.1
6,102,479 A * 8/2000 Wallace ..... 297/357
6,332,646 B1 * 12/2001 Tseng ..... 297/16.1

* cited by examiner

*Primary Examiner*—Milton Nelson, Jr.
(74) *Attorney, Agent, or Firm*—Alan D. Kamrath; Nikolai & Mersereau, P.A.

(57) ABSTRACT

A chair includes a first leg, a second leg pivotally mounted on the first leg, and a seat frame mounted on the first leg and the second leg by a plurality of detachable connecting members. Thus, the first leg, the second leg and the seat frame are assembled and disassembled easily and conveniently, thereby facilitating the user mounting the chair. In addition, the seat frame is combined with the first leg and the second leg by the connecting members, thereby simplifying the working procedure.

6 Claims, 6 Drawing Sheets

CHAIR HAVING RIGID STRUCTURE

BACKGROUND OF THE INVENTION

1. Field of the Invention

The present invention relates to a chair, and more particularly to a foldable chair having a rigid and stable structure.

2. Description of the Related Art

A conventional chair in accordance with the prior art shown in FIGS. 5 and 6 comprises a substantially U-shaped first leg 20, a substantially U-shaped second leg 10 pivotally mounted on the first leg 20 by two bent connecting levers 30, and a circular seat frame 40 having a periphery provided with a plurality of substantially U-shaped pivot ears 401 pivotally mounted on the first leg 20 and the second leg 10 by a plurality of rivets 56.

However, the manufacturer has to successively solder the pivot ears 401 on the seat frame 40 outdoors and then mount the pivot ears 401 on the first leg 20 and the second leg 10 indoors, thereby complicating the working and mounting procedures, increasing time of assembly, and thereby increasing costs of transportation.

SUMMARY OF THE INVENTION

The primary objective of the present invention is to provide a foldable chair having a rigid and stable structure.

Another objective of the present invention is to provide a chair, wherein the first leg, the second leg and the seat frame are assembled and disassembled easily and conveniently, thereby facilitating the user assembling and disassembling the chair.

A further objective of the present invention is to provide a chair, wherein the seat frame is combined with the first leg and the second leg by the connecting members, thereby simplifying the working procedure.

A further objective of the present invention is to provide a chair, wherein each of the connecting members is fixed on the seat frame, so that the chair has a rigid and stable structure.

In accordance with the present invention, there is provided a chair, comprising:

a first leg;

a second leg pivotally mounted on the first leg; and a seat frame mounted on the first leg and the second leg by a plurality of detachable connecting members.

Further benefits and advantages of the present invention will become apparent after a careful reading of the detailed description with appropriate reference to the accompanying drawings.

DETAILED DESCRIPTION OF THE INVENTION

Figure 1:
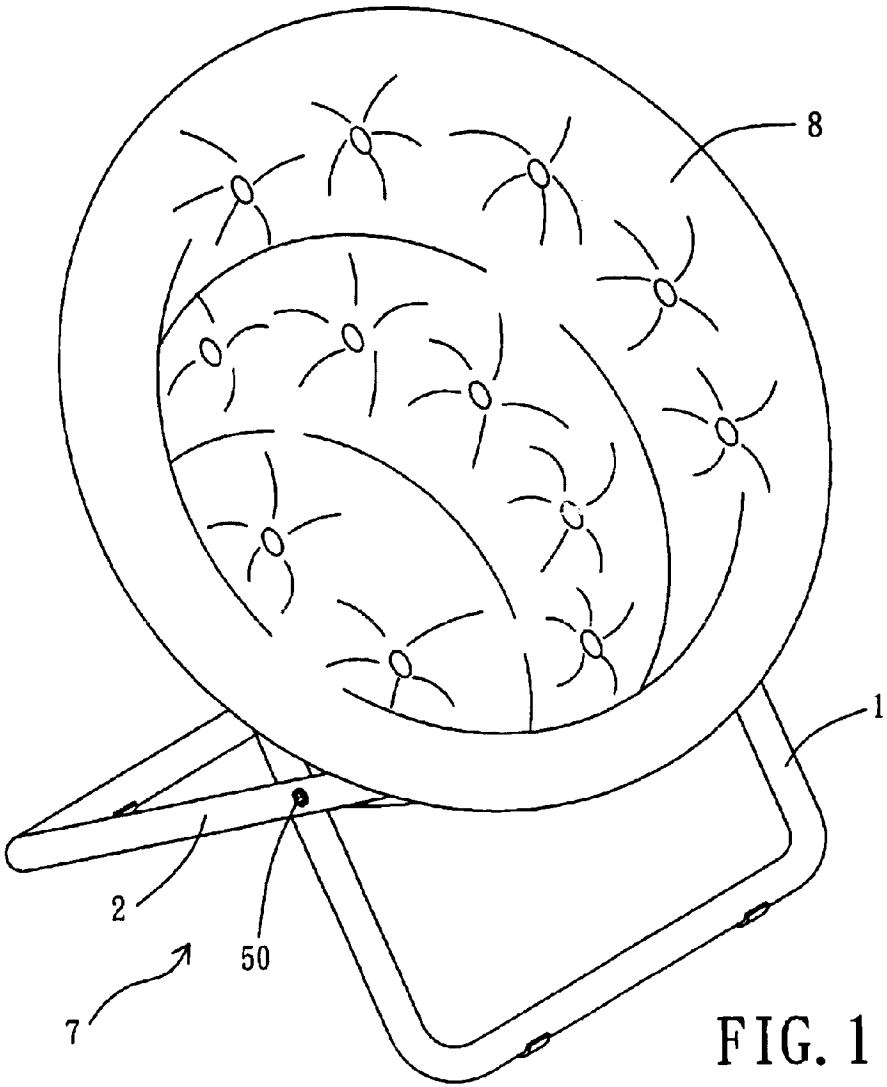
FIG. 1 is a perspective view of a chair in accordance with the preferred embodiment of the present invention.
Figure 2:
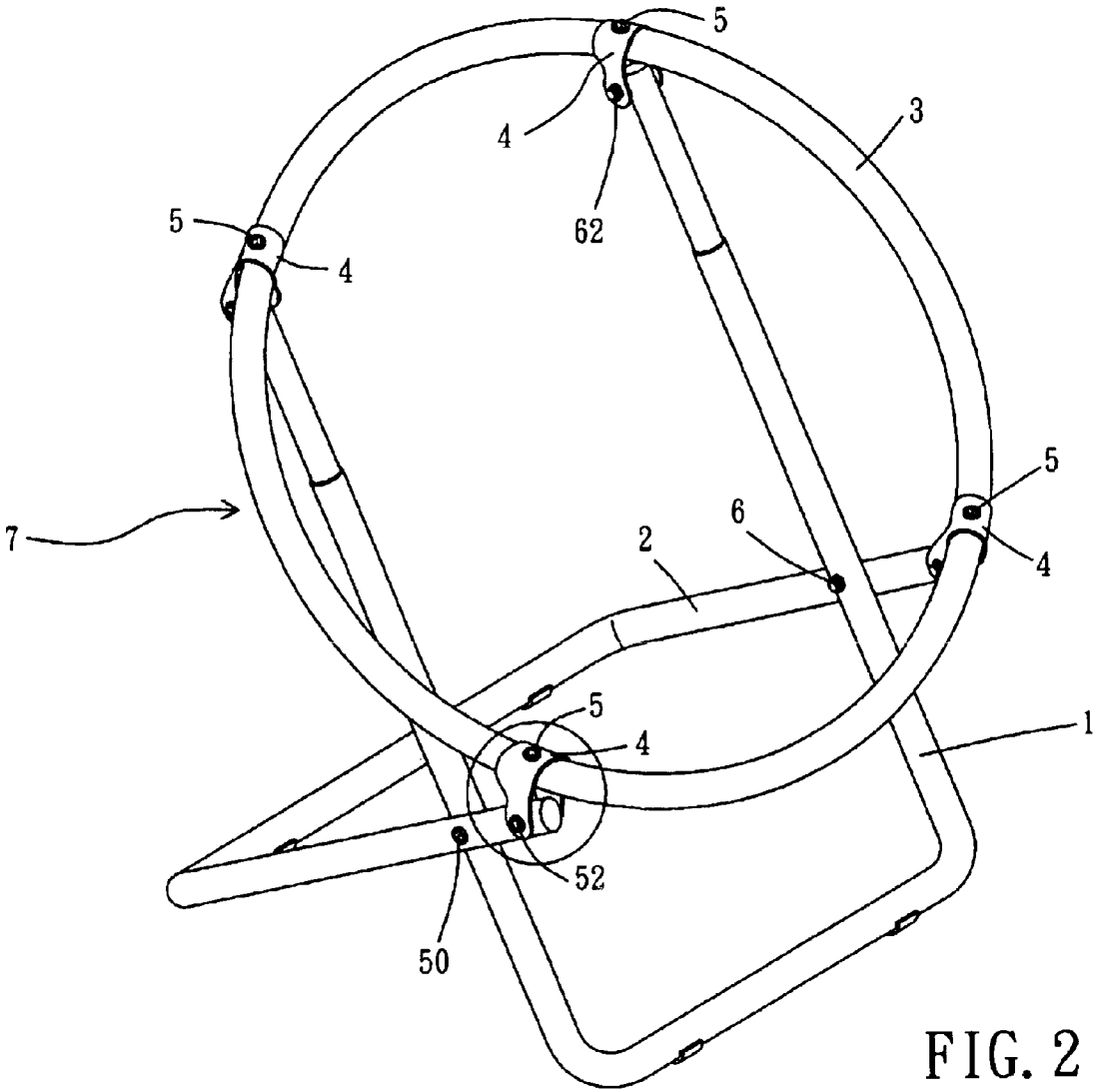
FIG. 2 is a partially perspective view of the chair in accordance with the preferred embodiment of the present invention.
Figure 3:
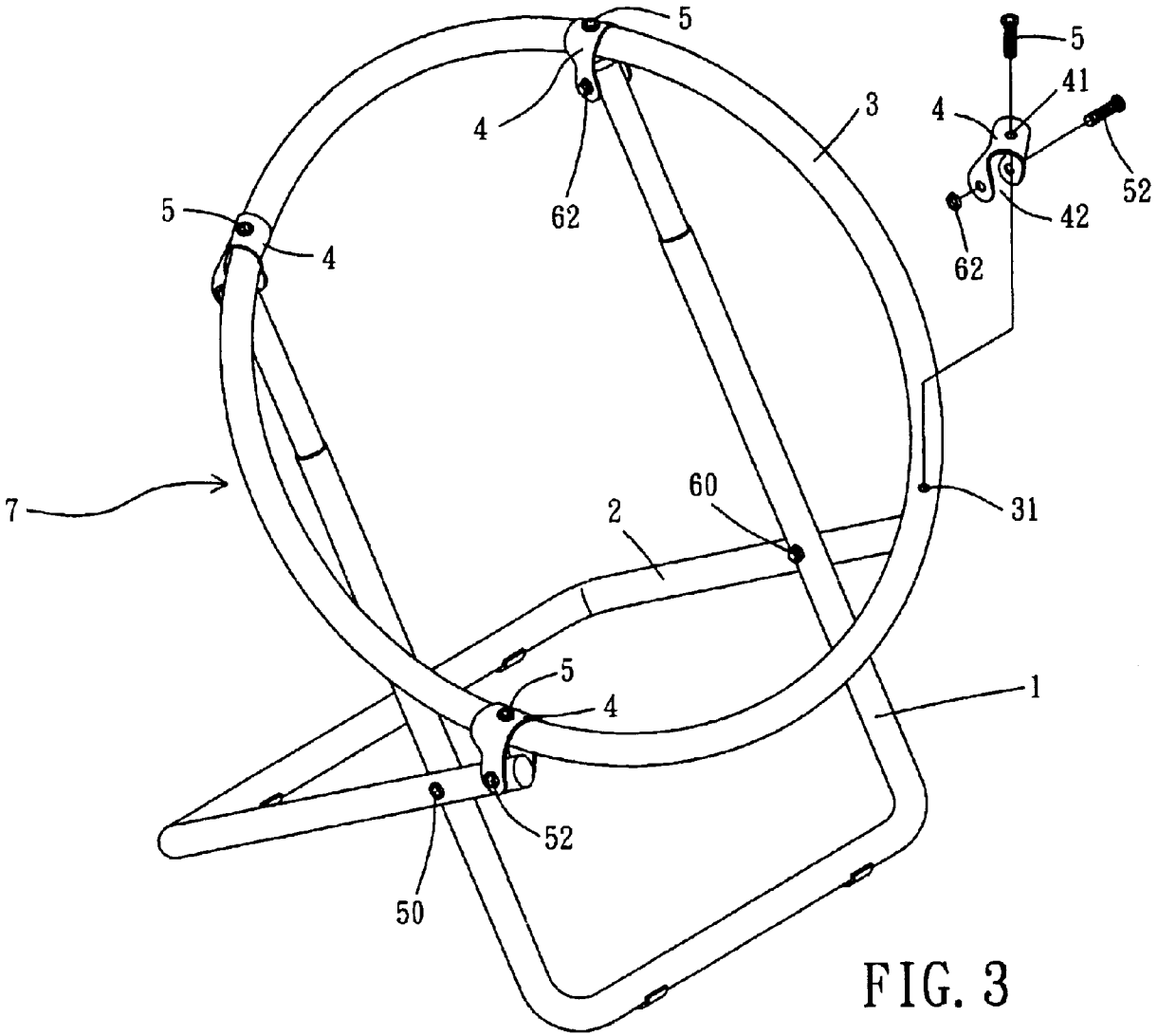
FIG. 3 is a partially exploded perspective view of the chair in accordance with the preferred embodiment of the present invention.
Figure 4:
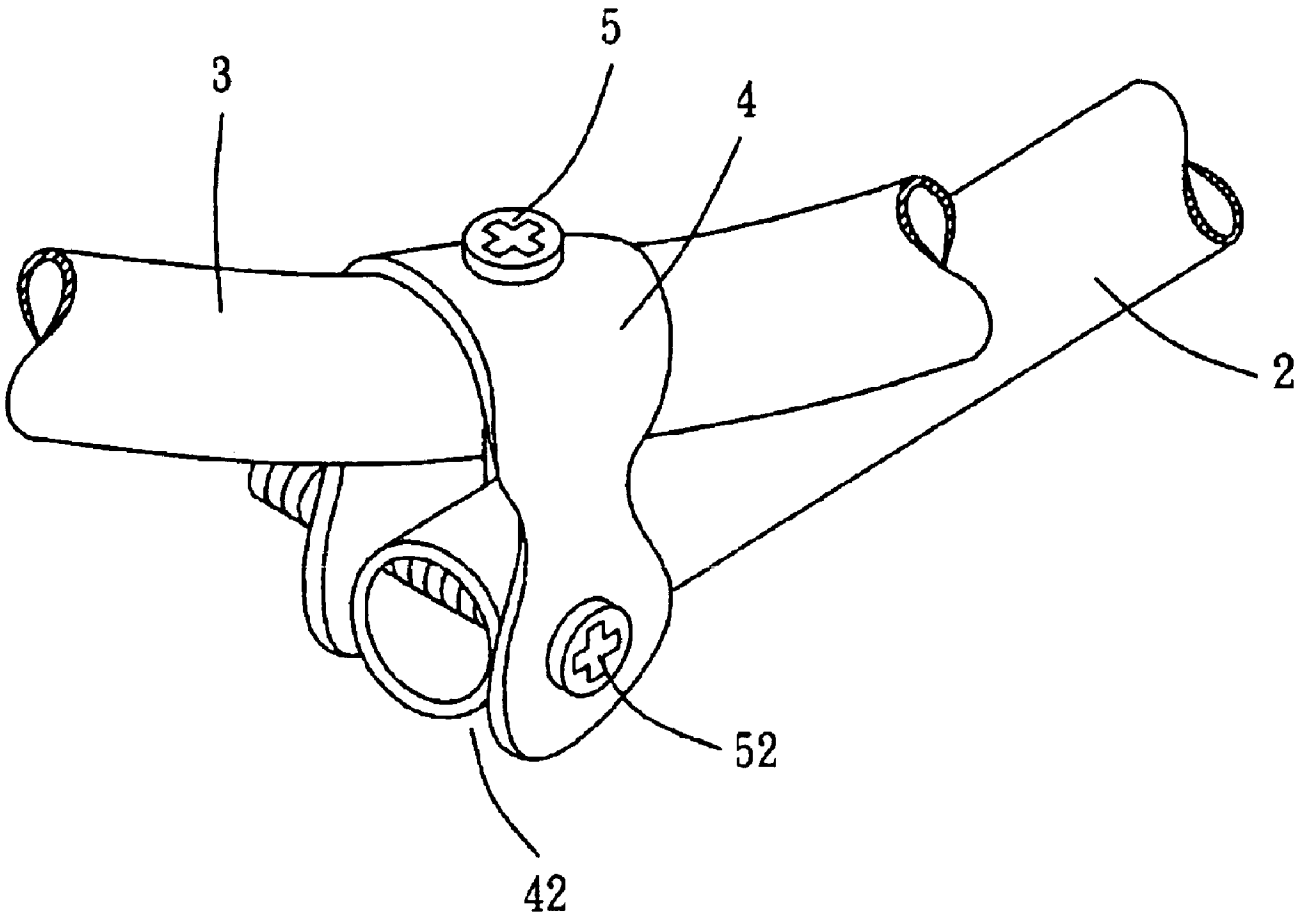
FIG. 4 is a partially enlarged view of the chair as shown in FIG. 2.
Figure 5:
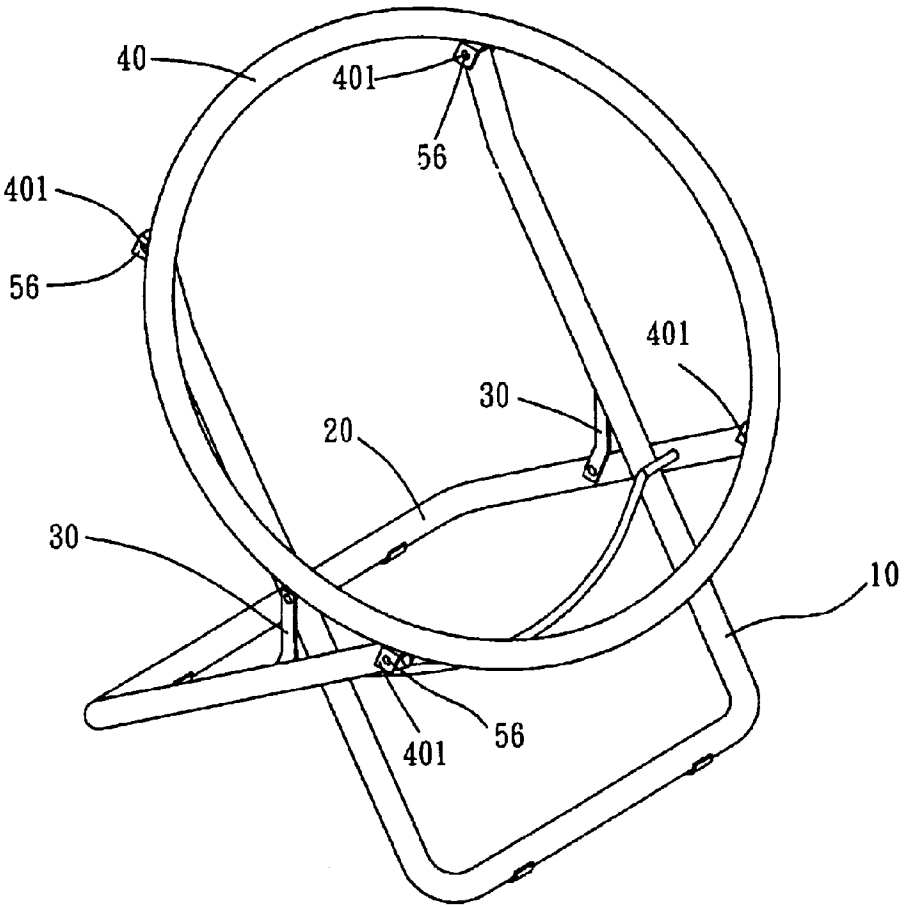
FIG. 5 PRIOR ART
FIG. 5 is a perspective view of a conventional chair in accordance with the prior art.
Figure 6:
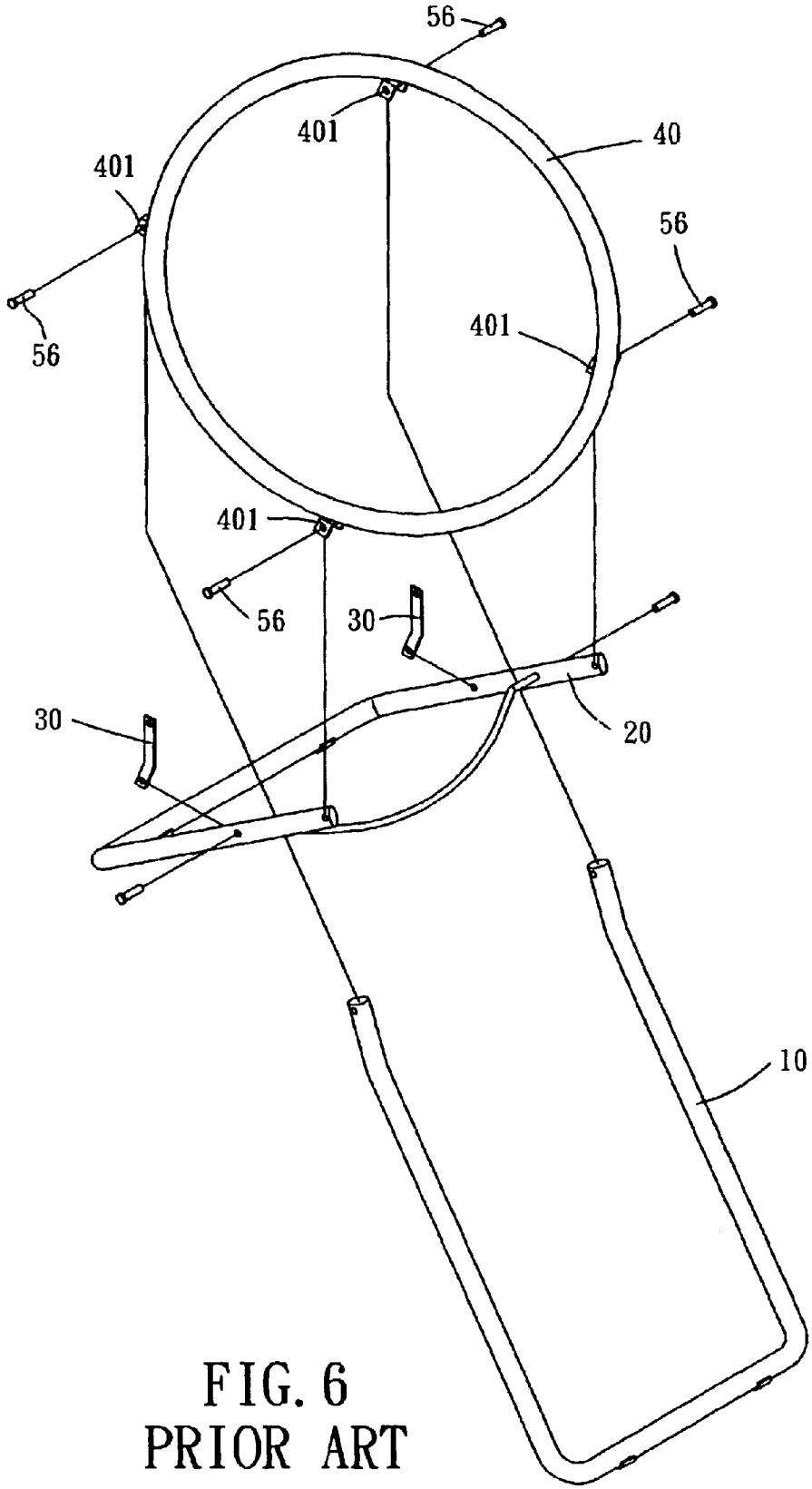
FIG. 6 PRIOR ART
FIG. 6 is an exploded perspective view of the conventional chair in accordance with the prior art.

Referring to the drawings and initially to FIGS. 1-3, a chair 7 in accordance with the preferred embodiment of the present invention comprises a substantially U-shaped first leg 1, a substantially U-shaped second leg 2 pivotally mounted on the first leg 1 by two screw members 50 and two nuts 60, a circular seat frame 3 mounted on the first leg 1 and the second leg 2 by a plurality of substantially inverted U-shaped connecting members 4, and a seat cushion 8 mounted on the seat frame 3.

Referring to FIGS. 1-4, each of the connecting members 4 has an inside formed with an opening 42 facing downward for mounting the first leg 1 or the second leg 2 and has a mediate portion formed with a through hole 41 communicating with the opening 42. The seat frame 3 has a periphery formed with a plurality of screw bores 31 each aligning with the through hole 41 of a respective one of the connecting members 4. The chair 7 further comprises a plurality of locking screws 5 each extended through the through hole 41 of a respective one of the connecting members 4 and each screwed into a respective one of the screw bores 31 of the seat frame 3, thereby fixing each of the connecting members 4 on the seat frame 3. Each of the connecting members 4 has two sides pivotally mounted on the first leg 1 or the second leg 2 by a screw member 52 and a nut 62.

Accordingly, the first leg 1, the second leg 2 and the seat frame 3 are assembled and disassembled easily and conveniently, thereby facilitating the user assembling and disassembling the chair 7. In addition, the seat frame 3 is combined with the first leg 1 and the second leg 2 by the connecting members 4, thereby simplifying the working procedure. Further, each of the connecting members 4 is fixed on the seat frame 3, so that the chair 7 has a rigid and stable structure.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A chair, comprising:

a first leg;

a second leg pivotally mounted on the first leg; and a seat frame mounted on the first leg and the second leg by a plurality of detachable connecting members, wherein:

each of the connecting members has an inside formed with an opening facing downward for mounting the first leg or the second leg;

each of the connecting members has a mediate portion formed with a through hole communicating with the opening:

the seat frame has a periphery formed with a plurality of screw bores each aligning with the through hole of a respective one of the connecting members; and the chair further comprises a plurality of locking screws each extended through the through hole of a respective one of the connecting members and each screwed into a respective one of the screw bores of the seat frame, thereby fixing each of the connecting members on the seat frame.

2. The chair in accordance with claim 1, wherein the second leg is pivotally mounted on the first leg by two screw members and two nuts.

3. The chair in accordance with claim 1, wherein each of the connecting members is substantially inverted U-shaped.

4. The chair in accordance with claim 1, wherein each of the connecting members is detachably mounted on the first leg or the second leg.

5. The chair in accordance with claim 1, wherein each of the connecting members is detachably mounted on the seat frame.

6. The chair in accordance with claim 1, wherein each of the connecting members has two sides pivotally mounted on the first leg or the second leg by a screw member and a nut.

* * * * *